US006776593B1

(12) United States Patent
Cho

(10) Patent No.: US 6,776,593 B1
(45) Date of Patent: Aug. 17, 2004

(54) SCROLL COMPRESSOR

(75) Inventor: Yang-Hee Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/452,310

(22) Filed: Jun. 3, 2003

(51) Int. Cl.[7] ..... F04C 18/00
(52) U.S. Cl. ..... 418/55.3; 464/102
(58) Field of Search ..... 418/55.3; 464/102

(56) References Cited

U.S. PATENT DOCUMENTS 5,516,267 A * 5/1996 Ikeda et al. ..... 418/55.3
5,569,028 A * 10/1996 Yamamura et al. ..... 418/55.3

FOREIGN PATENT DOCUMENTS

JP 58070003 A * 4/1983 ..... F04C/18/02
JP 02169884 A * 6/1990 ..... F04C/18/02
JP 06167284 A * 6/1994 ..... F04C/18/02

* cited by examiner

*Primary Examiner*—Thomas Denion
*Assistant Examiner*—Theresa Trieu
(74) *Attorney, Agent, or Firm*—Fleshner & Kim, LLP

(57) ABSTRACT

A scroll compressor comprising: an upper frame fixed in a case; a fixed scroll fixed to the upper frame and having a wrap of involute shape; an orbiting scroll installed between the upper frame and the fixed scroll and having a wrap of involute shape in order to form a compression space which consecutively moves by being engaged to the wrap of the fixed scroll; and a rotation preventing member slidably installed between the upper frame and the orbiting scroll towards a radius direction for preventing a rotation of the orbiting scroll and having a thrust bearing surface at an upper surface thereof which supports a shaft direction load of the orbiting scroll.

14 Claims, 5 Drawing Sheets

SCROLL COMPRESSOR

BACKGROUND OF THE INVENTION

1. Field of the Invention

The present invention relates to a scroll compressor, and more particularly, to a scroll compressor which can smooth an operation of an orbiting scroll and prevent overturn thereof by forming a thrust bearing surface at an upper surface of a rotation preventing member for preventing rotation of the orbiting scroll.

2. Description of the Related Art

Generally, a compressor which is one of the main components of a refrigerating cycle apparatus compresses refrigerant gas at low temperature and low pressure introduced from an evaporator and discharges it at a high temperature and high pressure.

The compressor can be divided into a reciprocating type, a scroll type, a centrifugal type, and a vane type.

The scroll compressor sucks, compresses, and discharges gas by using an orbiting movement of an orbiting scroll having a wrap of involute shape.

FIG. 1 is a longitudinal section view showing a scroll compressor in accordance with the conventional art; and FIG. 2 is a disassembled perspective view showing a compression unit of the scroll compressor in accordance with the conventional art.

As shown, in the conventional scroll compressor, an upper frame 2 is fixed to an inner upper portion of a hermetic case 1, and a lower frame 3 is fixed to an inner lower portion of the case 1.

A stator 4 and a rotor 5 constituting a motor are installed between the upper frame 2 and the lower frame 3.

A crank shaft 6 which is rotated together as the rotor 5 rotates is engaged to a center of the rotor 5.

A fixed scroll 7 having a wrap of involute shape 7*a* is installed at the upper frame 2 with a predetermined interval, and an orbiting scroll 8 having a wrap of involute shape is installed below the fixed scroll 7.

A key groove 8*b* for inserting a key 9*b* of an oldham coupling 9 which will be explained later is formed at lower both sides of the orbiting scroll 8.

The crank shaft 6 is engaged to a lower portion of the orbiting scroll 8, thereby orbiting the orbiting scroll 8.

An oldham coupling 9 for preventing rotation of the orbiting scroll 8 is slidably engaged between the orbiting scroll 8 and the upper frame 2.

The oldham coupling 9 is composed of a body 9*a* of a ring shape and upper and lower keys 9*b* and 9*c* formed at upper and lower portions of the body 9*a*.

An insertion hole 2*a* for inserting the crank shaft 6 is formed at a center of the upper frame 2, and a step portion 2*b* having a height h1 is formed at an upper surface of the upper frame 2 around the insertion hole 2*a*.

A key groove 2*c* for inserting the key 9*c* of the oldham coupling 9 is formed at one side of the upper surface of the upper frame 2, and an oil groove 2*d* for supplying oil to a thrust bearing surface B formed at the upper surface of the upper frame 2 is formed at another side thereof.

As shown in FIG. 2, a height h2 of the body 9*a* of the oldham coupling 9 is formed to be lower than that h1 of the step portion 2*b* formed at the upper surface of the upper frame 2.

This indicates that the step portion 2*b* where the thrust bearing surface B is formed can support the orbiting scroll 8 but the body 9*a* of the oldham coupling 9 can not support the orbiting scroll 8.

Also, oil is contained at the lower portion of the case 1 to be supplied to a sliding part (a contact part between the orbiting scroll and the thrust bearing surface). A suction pipe 10 for sucking refrigerant gas is formed at a lateral lower portion of the case 1, and a discharge pipe 11 for discharging the refrigerant gas is formed at the upper portion thereof. An unexplained reference numeral 7*b* denotes a discharge port.

In the conventional scroll compressor, when the rotor 5 is rotated by applied current, the crank shaft 6 is rotated and thereby the orbiting scroll 8 is orbited by having an eccentric distance of the crank shaft 6 as a radius.

At this time, the orbiting scroll 8 is prevented from being rotated by the oldham coupling 9 and orbits.

As the orbiting scroll 8 makes the orbit movement, a compression chamber P is formed between the fixed scroll 7 and the orbiting scroll 8, and the compression chamber P is gradually decreased, compresses the sucked refrigerant gas, and discharges it to the discharge pipe 11 through the discharge port 7*b*.

In the process that the orbiting scroll 8 makes the orbit movement by being engaged to the fixed scroll 7 to suck, compress, and discharge the refrigerant, force is applied to the orbiting scroll 8 towards a shaft direction, a radius direction, and a tangent direction by gas compression pressure or dead load of the orbiting scroll.

Herein, force towards the shaft direction influences on the orbiting movement of the orbiting scroll the most. According to this, the force towards the shaft direction has to be well supported to make the orbiting scroll orbit smoothly.

To this end, in the conventional art, the thrust bearing surface B is formed at the upper surface of the step portion 2*b* of the upper frame 2 which supports the lower surface of the orbiting scroll, and oil is supplied to the thrust bearing surface B.

In order to supply oil to the thrust bearing surface B, an oil passage hole 2*e* is formed in the upper frame 2 by being connected to the oil groove 2*d* formed at the upper surface of the step portion 2*b* of the upper frame 2, and the oil passage hole 2*e* is connected to the insertion hole 2*a*.

According to this, oil is pumped by an oil pump (not shown) engaged to a lower end of the crank shaft 6 as the crank shaft 6 rotates, and the pumped oil is sucked along an oil passage 6*a* of the crank shaft 6. The sucked oil is supplied to the oil groove 2*d* through the insertion hole 2*a* and the oil passage hole 2*e*, and introduced into the thrust bearing surface B, thereby performing a lubrication operation.

As aforementioned, in order to support the shaft direction load of the orbiting scroll 8 smoothly and induce the smooth orbiting movement of the orbiting scroll 8, the thrust bearing surface B has to always support the lower portion of the orbiting scroll 8.

However, in the conventional scroll compressor, since the thrust bearing surface B is fixed to the upper surface of the step portion 2*b* of the upper frame 2, the orbiting scroll makes the orbiting movement by exceeding a range of the thrust bearing surface B when a pressure of the refrigerant gas is drastically increased or an orbiting scroll having a high wrap is adopted.

When the orbiting scroll 8 makes the orbit movement by exceeding the range of the thrust bearing surface B, the thrust bearing surface B does not support the shaft direction load properly. According to this, the orbiting scroll 8 does not perform the orbit movement smoothly and can be overturn,

SUMMARY OF THE INVENTION

Therefore, an object of the present invention is to provide a scroll compressor which can smoothen an operation of an orbiting scroll and prevent overturn thereof by forming a thrust bearing surface at an upper surface of a rotation preventing member for preventing rotation of the orbiting scroll.

To achieve these and other advantages and in accordance with the purpose of the present invention, as embodied and broadly described herein, there is provided a scroll compressor comprising: an upper frame fixed in a case; a fixed scroll fixed to the upper frame and having a wrap of involute shape; an orbiting scroll installed between the frame and the fixed scroll and having a wrap of involute shape in order to form a compression chamber which consecutively moves by being engaged to the wrap of the fixed scroll; and a rotation preventing member slidably installed between the upper frame and the orbiting scroll towards a radius direction for preventing a rotation of the orbiting scroll and having a thrust bearing surface at an upper surface thereof which supports a shaft direction load of the orbiting scroll.

The rotation preventing member is composed of a ring type body having the thrust bearing surface and upper and lower keys formed at upper and lower portions of the body, in which the thrust bearing surface of the body supports a lower surface of the orbiting scroll.

A height of the body of the rotation preventing member is formed to be higher than that of a step portion formed at an upper surface of the frame.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
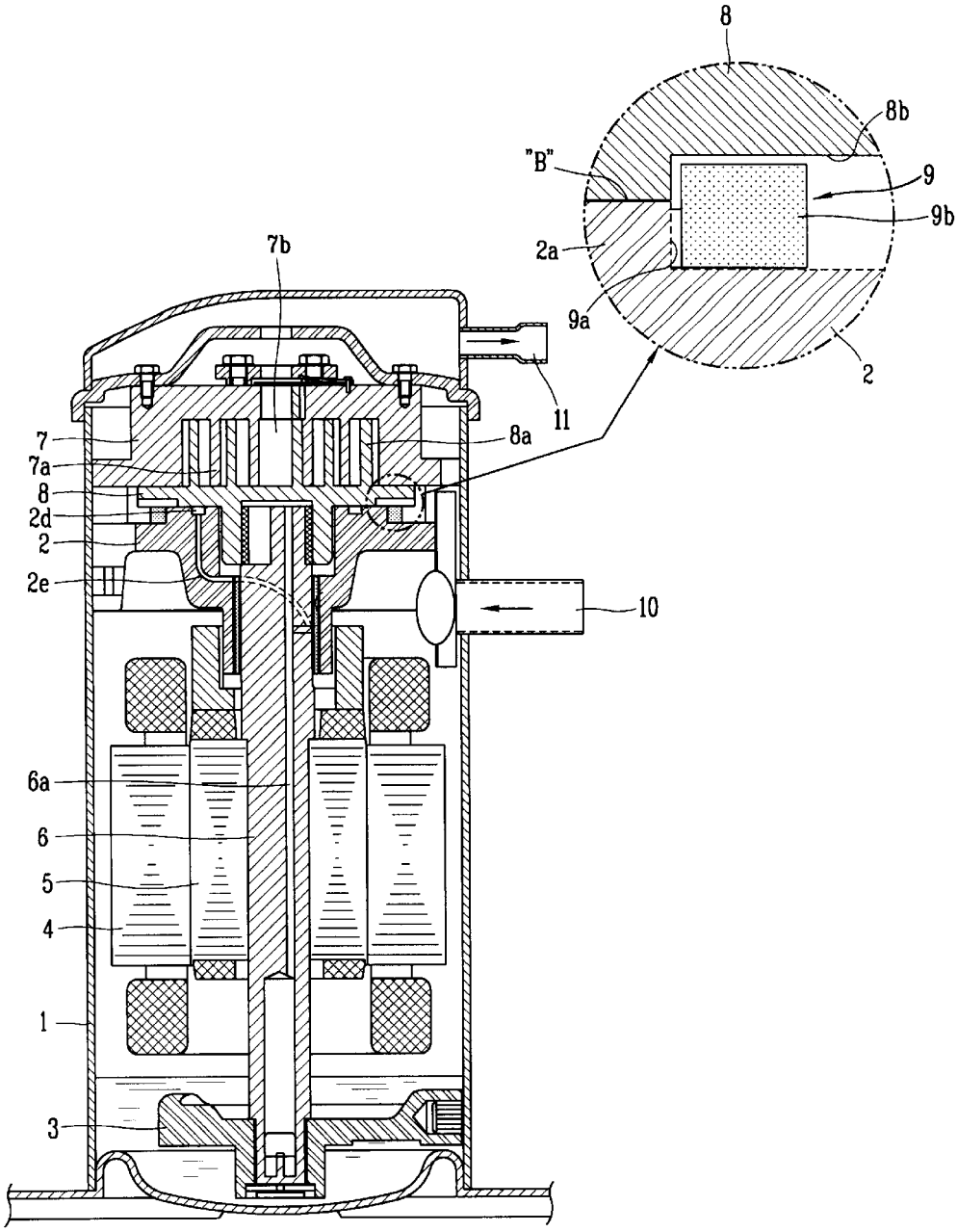
FIG. 1 CONVENTIONAL ART
FIG. 1 is a longitudinal section view showing a scroll compressor in accordance with the conventional art.
Figure 2:
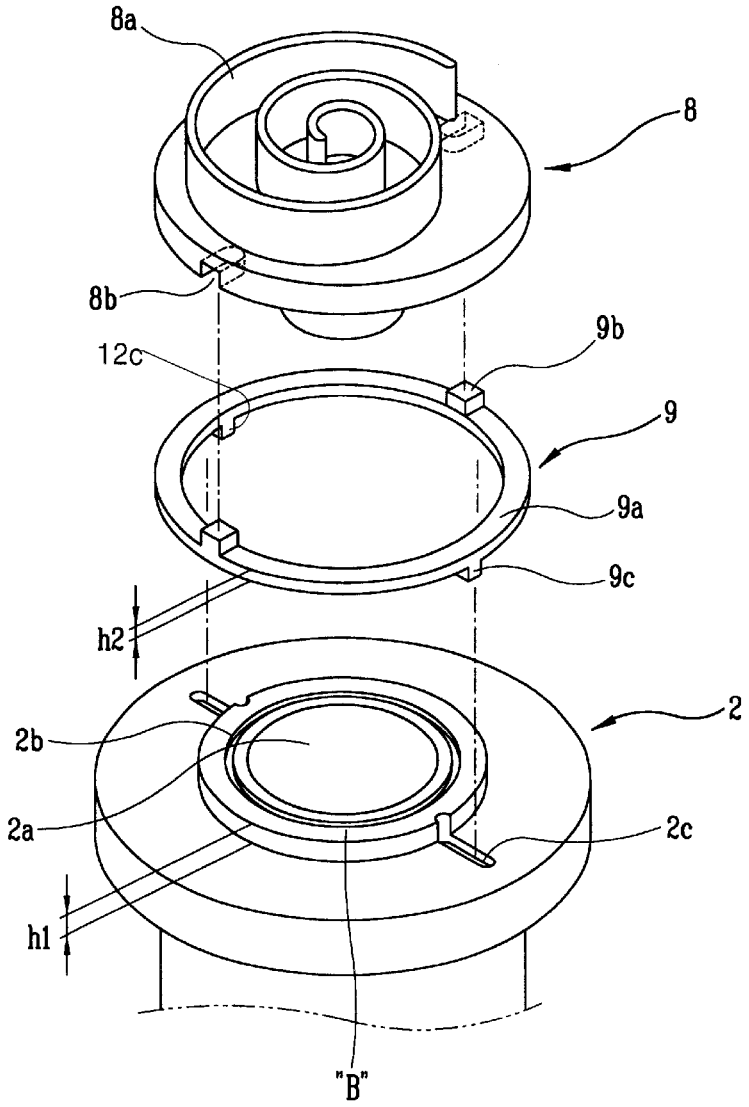
FIG. 2 CONVENTIONAL ART
FIG. 2 is a disassembled perspective view showing a compression unit of the scroll compressor in accordance with the conventional art.
Figure 3:
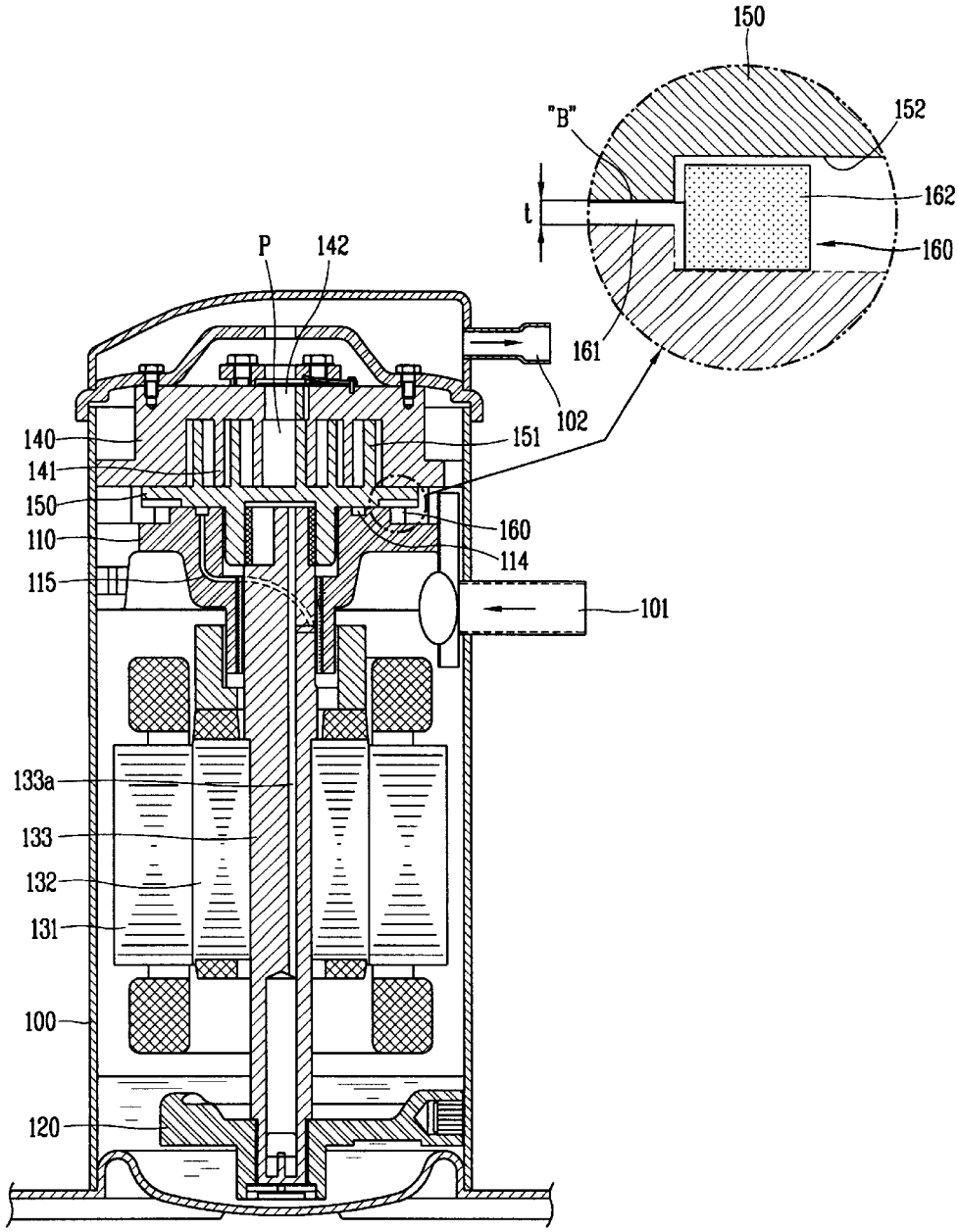
FIG. 3 is a longitudinal section view showing a scroll compressor according to the present invention.
Figure 4:
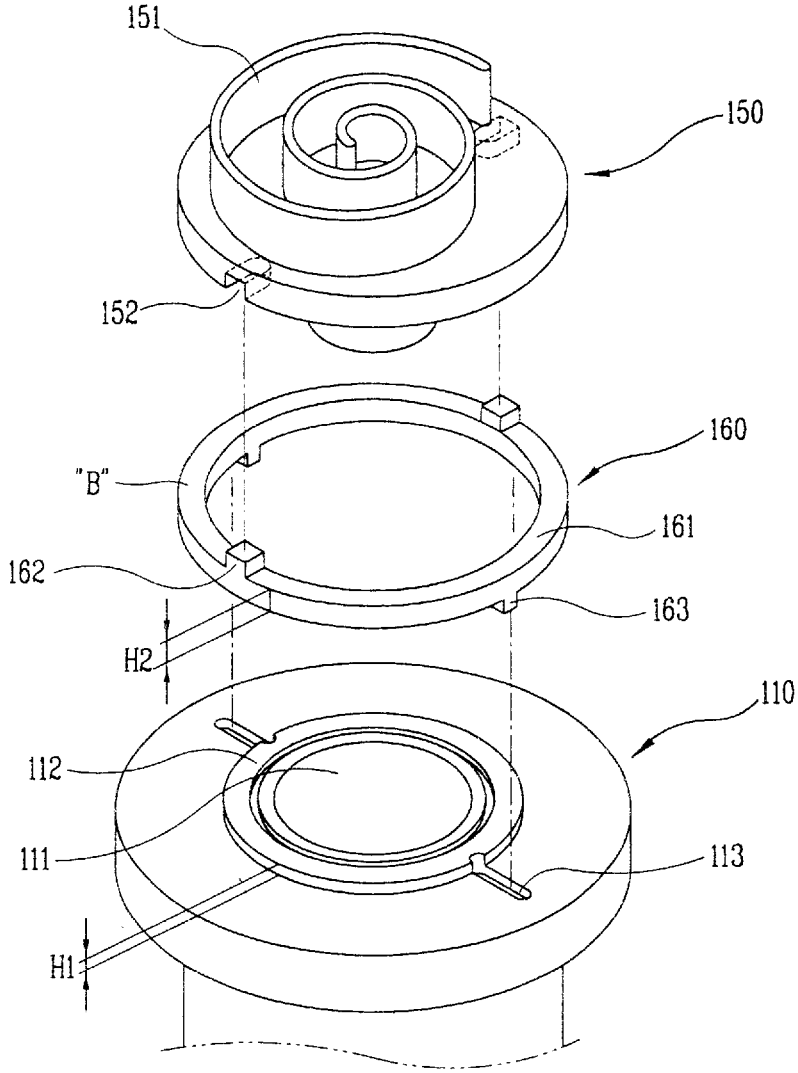
FIG. 4 is a disassembled perspective view showing a compression unit of the scroll compressor according to the present invention.

FIG. 3 is a longitudinal section view showing a scroll compressor according to the present invention, and FIG. 4 is a disassembled perspective view showing a compression unit of the scroll compressor according to the present invention.

As shown, in the scroll compressor according to the present invention, an upper frame 110 is fixed to a lateral upper portion of a hermetic case 100, and a lower frame 120 is fixed to a lateral lower portion of the case 100.

A stator 131 and a rotor 132 constituting a motor are installed between the upper frame 110 and the lower frame 120.

A crank shaft 133 which is rotated together as the rotor 132 rotates is engaged to a center of the rotor 132.

A fixed scroll 140 having a wrap 141 of involute shape is installed at the upper frame 110 with a predetermined interval, and an orbiting scroll 150 having a wrap 151 of involute shape is installed below the fixed scroll 140.

A key groove 152 for inserting a key 162 of an oldham coupling 160 which will be explained later is formed at lower both sides of the orbiting scroll 150.

The crank shaft 133 is engaged to a lower portion of the orbiting scroll 150, thereby making the orbiting scroll 150 orbit.

An oldham coupling 160 for preventing rotation of the orbiting scroll 150 is slidably engaged between the orbiting scroll 150 and the upper frame 110.

The oldham coupling 160 is composed of a ring type body 161 having a thrust bearing surface B, and upper and lower keys 162 and 163 formed at upper and lower portions of the body 161, in which the thrust bearing surface B of the body 161 supports a lower surface of the orbiting scroll 150.

An insertion hole 111 for inserting the crank shaft 133 is formed at a center of the upper frame 110, and a step portion 112 having a height H1 is formed at an upper surface of the upper frame 110 around the insertion hole 111. A key groove 113 for inserting the key 163 of the oldham coupling 160 is formed at one side of the upper surface of the upper frame 110, and an oil groove 114 for supplying oil to the thrust bearing surface B formed at the upper surface of the upper frame 110 is formed at another side thereof.

A height H2 of the body 161 of the oldham coupling 160 is formed to be higher than that H1 of the step portion 112 formed at the upper surface Of the upper frame 110.

This indicates that the body 161 of the oldham coupling 160 where the thrust bearing surface B is formed can support the orbiting scroll 150 upwardly but the step portion 112 of the upper frame 110 can not support the orbiting scroll 150 upwardly.

That is, the step portion 112 is separated from the orbiting scroll 150 with a predetermined distance, and the body 161 having the thrust bearing surface B of the oldham coupling 160 supports the orbiting scroll 150 upwardly by maintaining a minute clearance (gap) with the orbiting scroll 150 and by being slid by a lubrication operation of oil.

The step portion 112 and the oldham coupling 160 are preferably formed as a ring shape, but can be formed as polygonal or oval shapes.

Also, oil is contained at the lower portion of the case 100 to be supplied to a sliding part. A suction pipe 101 for sucking refrigerant gas is formed at a lateral upper portion of the case 100, and a discharge pipe 102 for discharging the refrigerant gas is formed at the lower portion thereof. Reference numeral 142 denotes a discharge port.

In the scroll compressor according to the present invention, when the rotor 132 is rotated by applied current, the crank shaft 133 is rotated and thereby the orbiting scroll 150 is orbited by having an eccentric distance of the crank shaft 133 as a radius.

At this time, the orbiting scroll 150 is prevented from being rotated by the oldham coupling 160 and makes the orbit movement.

As the orbiting scroll 150 makes the orbit movement, a compression chamber P is formed between the fixed scroll 140 and the orbiting scroll 150, and the compression chamber P is gradually decreased, compresses the sucked refrigerant gas, and discharges it to the discharge pipe 102 through the discharge port 142.

In the process that the orbiting scroll 150 makes the orbit movement by being engaged to the fixed scroll 140 to suck, compress, and discharge the refrigerant, force is applied to the orbiting scroll 150 towards a shaft direction, a radius direction, and a tangent direction by gas compression pressure or dead load of the orbiting scroll.

Herein, force towards the shaft direction influences on the orbiting movement of the orbiting scroll the most. According to this, the force towards the shaft direction has to be well supported and a friction between the orbiting scroll 150 and the upper frame 110 has to be reduced in order to make the orbiting scroll 150 orbit smoothly.

To this end, in the present invention, the thrust bearing surface B is formed at the upper surface of the body 161 of the oldham coupling 160, and oil is supplied to the thrust bearing surface B.

In order to supply oil to the thrust bearing surface B, an oil passage hole 115 is formed in the upper frame 110 by being connected to the oil groove 114 formed at the upper surface of the step portion 112 of the upper frame 110, and the oil passage hole 115 is connected to the insertion hole 111.

According to this, oil is pumped by an oil pump engaged to a lower end of the crank shaft 133 as the crank shaft 133 rotates, and the pumped oil is sucked along an oil passage 133*a* of the crank shaft 133. The sucked oil is supplied to the oil groove 114 through the insertion hole 111 and the oil passage hole 115, and introduced into the thrust bearing surface B, thereby performing a lubrication operation.

Also, in the scroll compressor according to the present invention, since the thrust bearing surface B is formed at the upper surface of the oldham coupling 160 which makes a sliding movement, a relative speed of the orbiting scroll 150 is reduced when compared with the conventional one.

That is, since the oldham coupling 160 also makes the sliding movement when the orbiting scroll 150 makes the orbit movement, the orbiting scroll 150 has a reduced movement displacement.

The thrust bearing surface of the present invention has an area smaller than that of the conventional one. However, differently from the conventional thrust bearing surface, the thrust bearing surface according to the present invention moves when the scroll compressor is operated, thereby obtaining an actual effect which can be obtained when the area is larger than that of the conventional one. According to this, the orbiting scroll is prevented from making the orbit movement by exceeding the range of the thrust bearing surface, the orbit movement of the orbiting scroll can be smoothened, and overturn of the orbiting scroll can be prevented.

Also, since the thrust bearing surface according to the present invention moves differently from the conventional one, oil supplied through the oil groove 114 can be supplied to the entire thrust bearing surface B faster.

Figure 5:
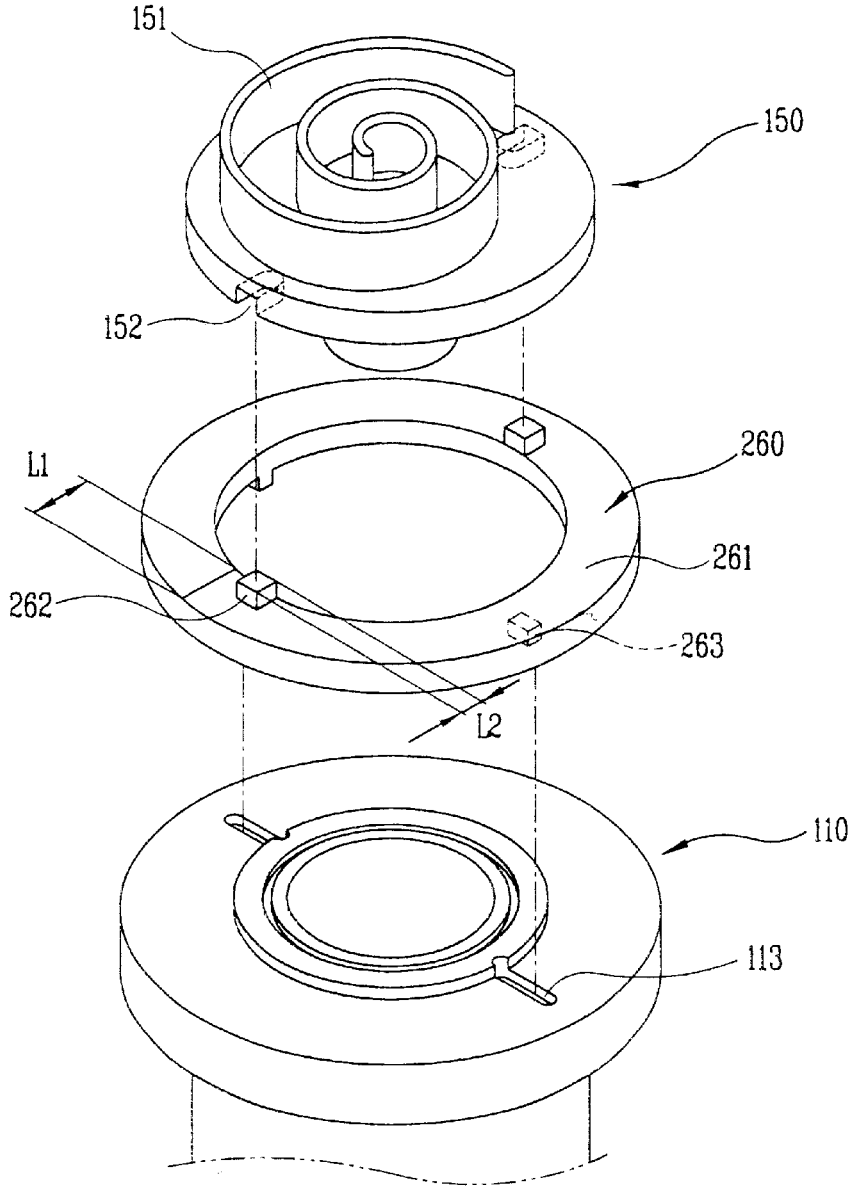
FIG. 5 is a perspective view showing a modification example of an oldham coupling of the scroll compressor according to the present invention.

FIG. 5 is a perspective view showing a modification example of an oldham coupling of the scroll compressor according to the present invention.

As shown, in case of forming a width L1 of a body 261 of an oldham coupling 260, the width L1 of the body 261 of the oldham coupling 260 can be formed to be larger than that L2 of a key 262 by considering friction loss generated when the orbiting scroll 150 makes the orbit movement and a gas pressure applied to the wrap 151 of the orbiting scroll 150.

As aforementioned, in the present invention, the thrust bearing surface is formed at the upper surface of the oldham coupling, thereby having a larger area than the conventional thrust bearing surface formed at the step portion of the upper frame, and supplying oil to the entire thrust bearing surface uniformly and faster.

According to this, even in case that gas pressure is drastically increased or an orbiting scroll having a high wrap is adopted, the orbit movement of the orbiting scroll is performed within a range of the thrust bearing surface, thereby smoothly performing the orbit movement of the orbiting scroll and preventing the overturn of the orbiting scroll.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A scroll compressor, comprising:

an upper frame fixed in a case;

a fixed scroll fixed to the upper frame and having a wrap of involute shape;

an orbiting scroll installed between the upper frame and the fixed scroll and having a wrap of involute shape in order to form a compression chamber which consecutively moves by being engaged to the wrap of the fixed scroll; and a rotation preventing member slidably installed between the upper frame and the orbiting scroll towards a radius direction for preventing a rotation of the orbiting scroll and having a thrust bearing surface at an upper surface thereof which supports a shaft direction load of the orbiting scroll, wherein a height H2 of a body of the rotation preventing member is formed to be higher than a height H1 of a step portion formed at an upper surface of the upper frame.

2. The scroll compressor of claim 1, wherein the rotation preventing member comprises a ring type body having the thrust bearing surface and upper and lower keys formed at upper and lower portions of the body, and wherein the thrust bearing surface of the body is configured to support a lower surface of the orbiting scroll.

3. The scroll compressor of claim 1, wherein the step portion and the rotation preventing member are in the shape of a ring.

4. The scroll compressor of claim 1, wherein a width L1 of a body of the rotation preventing member is formed to be greater than a width L2 of a key.

5. A scroll compressor, comprising an upper frame fixed in a case;

a fixed scroll fixed to the upper frame and having a wrap of involute shape;

an orbiting scroll installed between the upper frame and the fixed scroll and having a wrap of involute shape in order to form a compression chamber which consecutively moves by being engaged to the wrap of the fixed scroll; and a rotation preventing member slidably installed between the upper frame and the orbiting scroll towards a radius direction for preventing a rotation of the orbiting scroll and having a thrust bearing surface at an upper surface thereof which supports a shaft direction load of the orbiting scroll, wherein a width L1 of a body of the rotation preventing member is formed to be greater than a width L2 of a key formed on the upper surface or a lower surface of the rotation preventing member and configured to be received in a radial groove formed on a lower surface of the orbiting scroll or an upper surface of the upper frame.

6. The scroll compressor of claim 5, wherein the rotation preventing member comprises a ring type body having the thrust bearing surface and upper and lower keys formed at upper and lower portions of the body, and wherein the thrust bearing surface of the body is constructed to support a lower surface of the orbiting scroll.

7. The scroll compressor of claim 5, wherein a step portion and the rotation preventing member are in the shape of a ring.

8. A scroll compressor, comprising:

an upper frame;

a fixed scroll fixed to the upper frame;

an orbiting scroll installed between the upper frame and the fixed scroll so as to form a compression chamber therebetween; and a rotation preventing member slidably installed between the upper frame and the orbiting scroll and configured to prevent rotation of the orbiting scroll and having a thrust bearing surface at an upper surface thereof which supports a shaft direction load of the orbiting scroll, wherein a height H2 of a body of the rotation preventing member is formed to be higher than a height H1 of a step portion formed at an upper surface of the upper frame.

9. The scroll compressor of claim 8, wherein the rotation preventing member comprises of a ring type body having the thrust bearing surface and upper and lower keys formed at upper and lower portions of the body, and wherein the thrust bearing surface of the body is configured to support a lower surface of the orbiting scroll.

10. The scroll compressor of claim 8, wherein the step portion and the rotation preventing member are in the shape of a ring.

11. The scroll compressor of claim 8, wherein a width L1 of a body of the rotation preventing member is configured to be greater than a width L2 of a key.

12. A scroll compressor, comprising an upper frame;

a fixed scroll fixed to the upper frame;

an orbiting scroll installed between the upper frame and the fixed scroll so as to form a compression chamber; and a rotation preventing member slidably installed between the upper frame and the orbiting scroll and configured to prevent rotation of the orbiting scroll and having a thrust bearing surface at an upper surface thereof which supports a shaft direction load of the orbiting scroll, wherein a width L1 of a body of the rotation preventing member is formed to be greater than a width L2 of a key formed on the upper surface or a lower surface of the rotation preventing member and configured to be received in a radial groove formed of a lower surface of the orbiting scroll or an upper surface of the upper frame.

13. The scroll compressor of claim 12, wherein the rotation preventing member comprises a ring type body having the thrust bearing surface and upper and lower keys formed at upper and lower portions of the body, and wherein the thrust bearing surface of the body is constructed to support a lower surface of the orbiting scroll.

14. The scroll compressor of claim 5, wherein a step portion and the rotation preventing member are in the shape of a ring.

* * * * *